US009415604B2

(12) United States Patent
Fischer

(10) Patent No.: US 9,415,604 B2
(45) Date of Patent: Aug. 16, 2016

(54) SECURE PRINTING USING SLICED DATA

(71) Applicant: ENTRUST DATACARD CORPORATION, Shakopee, MN (US)

(72) Inventor: Ken C. Fischer, Bloomington, MN (US)

(73) Assignee: ENTRUST DATACARD CORPORATION MN (US)

( * ) Notice: Subject to any disclaimer, the term of this patent is extended or adjusted under 35 U.S.C. 154(b) by 0 days.

(21) Appl. No.: 14/808,661

(22) Filed: Jul. 24, 2015

(65) Prior Publication Data

US 2016/0023473 A1 Jan. 28, 2016

Related U.S. Application Data

(60) Provisional application No. 62/029,126, filed on Jul. 25, 2014.

(51) Int. Cl.

| | |
|---|---|
| ***B41J 2/325*** | (2006.01) |
| ***B42D 25/30*** | (2014.01) |
| *B41J 13/12* | (2006.01) |

(52) U.S. Cl.

CPC ..... *B41J 2/325* (2013.01); *B42D 25/30* (2014.10); *B41J 13/12* (2013.01)

(58) Field of Classification Search

CPC ..... B41J 2/325; B41J 13/12; B41J 2/0057; B41J 2202/35; B65H 2701/372; B65H 2701/1914

See application file for complete search history.

(56) References Cited

U.S. PATENT DOCUMENTS

| | | | |
|---|---|---|---|
| 6,262,755 | B1 | 7/2001 | Skubic et al. |
| 6,891,555 | B2 | 5/2005 | Minowa et al. |
| 6,902,107 | B2 | 6/2005 | Shay et al. |
| 7,434,728 | B2 | 10/2008 | Paulson et al. |
| 8,292,167 | B2 | 10/2012 | Behner et al. |
| 2004/0109715 | A1 | 6/2004 | Meier et al. |
| 2008/0121699 | A1 | 5/2008 | Thorsen et al. |
| 2013/0032587 | A1 | 2/2013 | Flitsch et al. |
| 2014/0132967 | A1 | 5/2014 | Higashi et al. |

FOREIGN PATENT DOCUMENTS

| | | |
|---|---|---|
| JP | 3484246 | 1/2004 |
| KR | 10-2006-0112125 | 10/2006 |
| WO | 92/17856 | 10/1992 |

OTHER PUBLICATIONS

International Search Report and Written Opinion for International Application No. PCT/US2015/041906, dated Oct. 15, 2015, 13 pgs.

*Primary Examiner* — Thinh Nguyen

(74) *Attorney, Agent, or Firm* — Hamre, Schumann, Mueller & Larson, P.C.

(57) ABSTRACT

An image to be printed on a surface of a substrate that forms, or will be used in, a personalized security document is generated. The image to be printed is then sliced, divided, separated, etc. into a plurality of separate image portions. Each of the separate image portions is then printed onto the substrate. Together, the separate printed image portions form the desired image on the substrate. Each image portion contains only a portion of any confidential or personal information. Each separate image portion is printed using separate sections of a single print ribbon. Since each image portion is printed using a different section of the print ribbon, each ribbon section contains only a portion of any confidential or personal information. This makes it difficult for someone to obtain the confidential or personal information from just a brief or casual glance at the used print ribbon.

15 Claims, 15 Drawing Sheets

SECURE PRINTING USING SLICED DATA

FIELD

Embodiments of this disclosure relate generally to systems, apparatus, and methods for printing on security document substrates to create personalized security documents, such as plastic cards and passports.

BACKGROUND

Many forms of personalized security documents are known including plastic cards that can serve as identification cards, driver's licenses, financial cards (e.g., credit card, debit card), phone cards, health cards, or the like, as well as security documents such as passports. Personalized security documents often have certain information provided thereon, including but not limited to account numbers, employee numbers, passport numbers, personal information or the like, that can be considered confidential or that it is generally desirable to prevent others from obtaining This information may be printed on a surface of the document often times using a printing process that employs a print ribbon. FIG. 1 illustrates an example of a personalized security document 1 in the form of a plastic financial card such as a credit card. In this example, the surface of the security document 1 is printed with data such as an account number 2, card expiration information 3, the cardholder's name 4, and the name of the bank or other financial institution 5. Other data or material can be printed on the card surface such as a photograph of the cardholder, a logo or other graphics, and the like.

When a print ribbon or other ribbon material is used to print/produce information on a plastic card, passport or other personalized security document, certain confidential information, such as account numbers and the like, are left behind on the used ribbon where the dye or ink from the ribbon was transferred to the document. For example, FIG. 2 illustrates a portion of a used print ribbon 6 that was used to print the data on the card 1 in FIG. 1. The used print ribbon 6 contains portions where dye or ink from the ribbon was transferred from the print ribbon to the card 1 leaving behind blank areas (i.e. areas with little or no remaining dye or ink) identical to the data printed on the card 1. Therefore, someone with even short term access to the used print ribbon 6 can potentially obtain confidential information from the used ribbon 6, which can then result in unauthorized use of, for example, account numbers and/or creation of counterfeit personalized security documents. U.S. Published Application No. 2013/0032587 describes one technique of minimizing access to information on a used print ribbon that involves destroying the used ribbon after it is used.

One known technique for printing data on a card surface involves creating a set of partial data strings by manipulating the original data into the partial data strings. In this technique, the printer would pull the original data apart and create the partial data strings. For example, if the data sent to the printer was "12345", the following three partial data strings could be created with spaces where the missing data characters would be: "1 3", "2 5", and "4". An image is then created for each partial data string to create partial data string images. Each partial data string image is then individually printed using a separate section of print ribbon, with the card being re-homed prior to each printing pass. The resulting completed printed image is "12345". This technique works only if the data is printed in a non-proportional font that has equal spaces for all characters. In addition, the partial data strings must include complete characters. This technique breaks apart a series of data characters into partial data strings and then creates an image for each partial data string. This technique does not manipulate an image itself into separate image portions.

SUMMARY

This disclosure describes techniques that make it difficult for someone to obtain confidential or personal information from one or more used print ribbons after the print ribbon(s) has been used to print information on a surface of a substrate to form a personalized security document. Examples of personalized security documents that can benefit from the techniques described herein include, but are not limited to, plastic cards (or similar cards formed from composite materials) that serve as identification cards, driver's licenses, financial cards (e.g., credit cards, debit cards), phone cards, health cards, or the like, and documents such as passports. The substrates that can be printed on include, but are not limited to, a plastic card substrate, a transfer material that is printed on and then transferred by lamination onto a plastic card substrate (i.e. retransfer printing), a page of a passport, or the like.

In one embodiment, an image to be printed on a surface of a substrate that forms, or will be used in, a personalized security document is generated. The image to be printed is then sliced, divided, separated, etc. into a plurality of separate image portions. Each of the separate image portions is then printed onto the substrate. Together, the separate printed image portions form the desired image on the substrate. However, separately, each image portion contains only a portion of any confidential or personal information.

In one embodiment, each separate image portion is printed using separate sections of a single print ribbon. Since each image portion is printed using a different section of the print ribbon, each ribbon section contains only a portion of any confidential or personal information. This makes it difficult for someone to obtain the confidential or personal information from just a brief or casual glance at the used print ribbon since no single section of the print ribbon contains a complete replication of the confidential or personal information.

In another embodiment, to further enhance security, each image portion can be printed using a different print ribbon. In this embodiment, one would need long term access to each used print ribbon in order to acquire the confidential or personal information.

The confidential or personal information can be any information printed on the resulting card or passport that one wishes to deter others from obtaining from the used ribbon that was used to print the information on the card or passport. Examples of confidential or personal information include, but are not limited to, an account number, a card security code (often called a card verification value (CVV) or card verification code (CVC)), an employee number, passport number, a person's name, or the like.

The techniques described herein can be implemented in any type of plastic card or passport printer where one or more print ribbons are used to print on the substrate. An example of a printer that can be used is desktop printer that has a relatively small footprint intended to permit the desktop printer to reside on a desktop and that is designed to personalize cards or other documents in relatively small volumes, for example measured in tens or low hundreds per hour. An example of a desktop printer is the CD800 Card Printer available from Entrust Datacard Corporation of Shakopee, Minnesota. Another example of a printer is a large volume batch production machine, often configured with multiple processing stations or modules, typically referred to as a central issuance system, that processes multiple documents, such as cards or passports, at the same time and is designed to personalize cards, passports or other documents in relatively large volumes, for example measured in the high hundreds or even thousands per hour. An example of a central issuance system is the MX or MPR-lines of central issuance systems available from Entrust Datacard Corporation of Shakopee, Minnesota.

The printer that is implemented with the techniques described herein can have many configurations as long as it uses at least one print ribbon and at least one print head to print on the substrate. For example, the printer can have a single print head and a single print ribbon, multiple print heads with multiple print ribbons, or a single print head with multiple print ribbons. In another embodiment, each image portion could be printed in a different printer.

The printing that is implemented by the printer can be any printing type that uses a print ribbon. Examples of printing types include, but are not limited to, dye diffusion, dye sublimation, ink, thermal transfer, pigment, or the like.

In one specific embodiment, a process of printing an image on a surface of a card substrate using a printer with a print head and a print ribbon includes generating the image to be printed on the surface of the card substrate. The image itself is then divided into a plurality of separate image portions. Each image portion is then printed on the surface of a card substrate that has been input into the printer. Each image portion is printed using the print head and a separate section of the print ribbon, and the image portions printed on the surface of the card substrate form the image.

In yet another specific embodiment, an image is generated that is to be printed on a surface of a security document substrate. The image itself is then divided into a plurality of separate image portions. The image portions can then be transmitted to the security document printer for printing of the image portions. Each image portion can be separately printed on the surface of the security document substrate using a print head and a print ribbon, and each image portion is printed using a new section of the print ribbon. Alternatively, each image portion can be printed using a plurality of print head and print ribbon combinations, and each image portion is printed using a separate one of the print head and print ribbon combinations.

In one embodiment, the image portions are created by using masks that mask portions of the image to be printed. One advantage of using masks is that the desired portions of the image can be masked separately and to the desired extent. In addition, in some embodiments, individual characters can be split as opposed to the creation of the partial data strings discussed above where whole characters must be utilized in each partial data string.

The printers and methods described herein can be incorporated into self-service systems or kiosks. The self-service systems can include a housing containing a printer adapted to issue a personalized security document and a user interface such as, for example, a touchscreen, keyboard, display screen or combination thereof. The self-service systems can also include communication equipment that facilitates the exchange of information and/or data with a remote computer or server. Optionally, the self-service kiosk can include a camera, scanner, paper printer (for example an ink jet printer) or combinations thereof. An example of a self-service system or kiosk is described in US 2008/0121699 and WO 92/17856 each of which is incorporated herein by reference in its entirety.

The printers and methods described herein can also be incorporated into instant issuance systems. An example of an instant issuance system is described in U.S. Pat. No. 8,292,167 that is incorporated herein by reference in its entirety.

Other innovative embodiments include a system that includes a plastic card or passport printer having a print head, a print ribbon, a controller and a printer driver. In one embodiment, the image portions are generated in the printer driver and sent to the controller.

The resulting used print ribbon is also unique since the used ribbon includes a plurality of sequential, separate image portions formed in the thermally transferrable dye or ink on the substrate web of the ribbon. If viewed separately, the sequential image portions in the used ribbon do not provide sufficient information in a brief or casual glance of the used ribbon to allow one to obtain the confidential or personal information therefrom. However, if the image portions are combined together the resulting combined image would be identical to the image that was printed on the surface of the substrate using the print ribbon.

DRAWINGS

Figure 8:
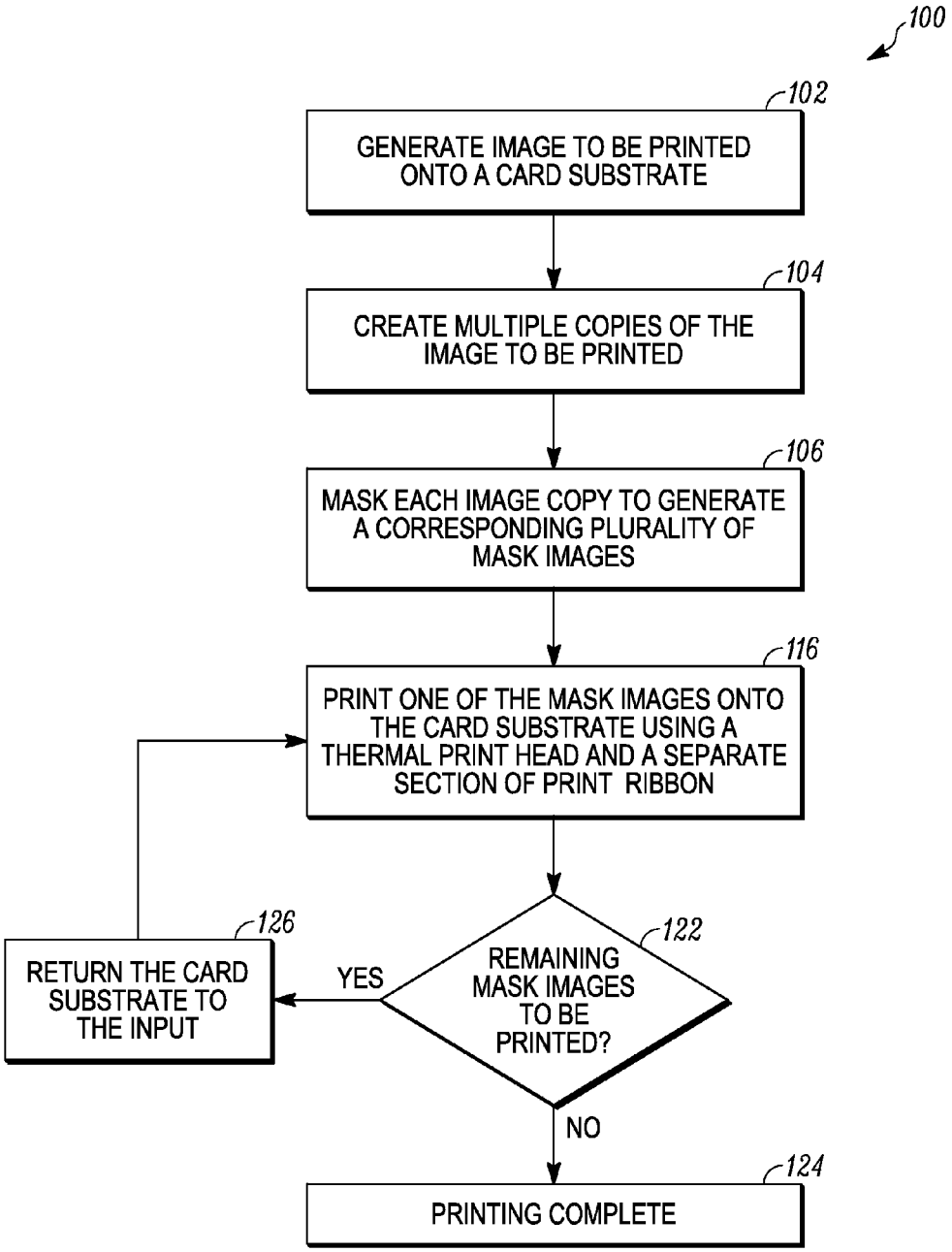
FIG. 8 is a flow chart of another embodiment of a method of printing described herein.
Figure 9A:
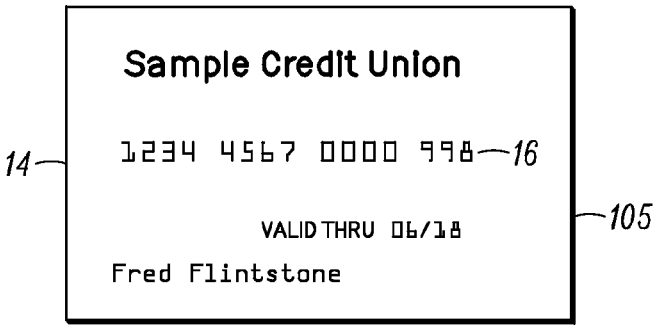
Figure 9B:
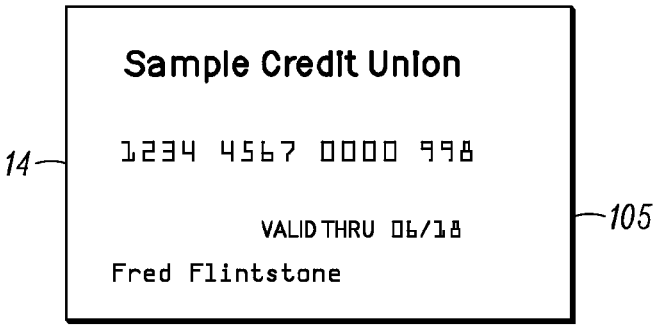
Figure 9C:
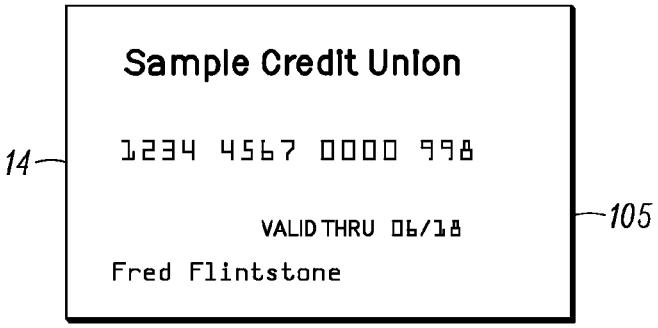

FIGS. 9A-C illustrate a first step in the method of FIG. 8.

Figure 10A:
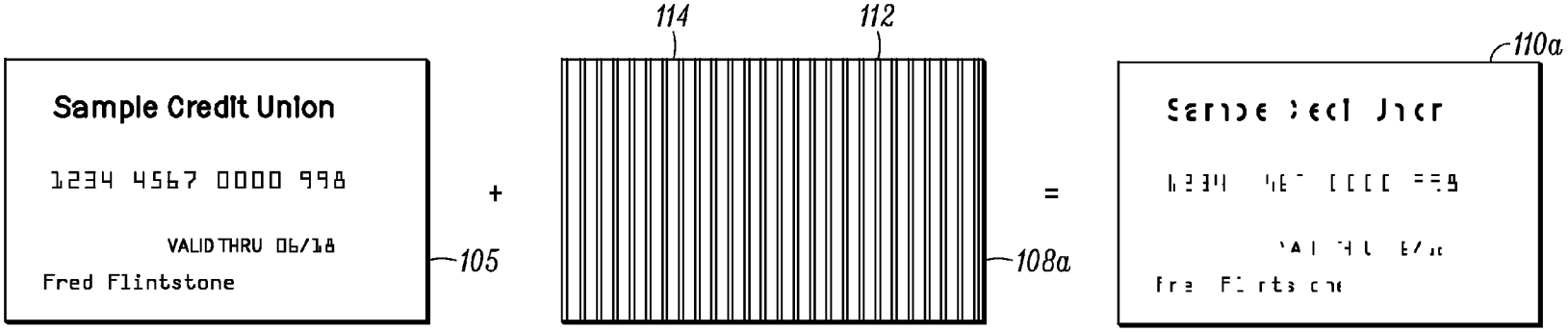
Figure 10B:
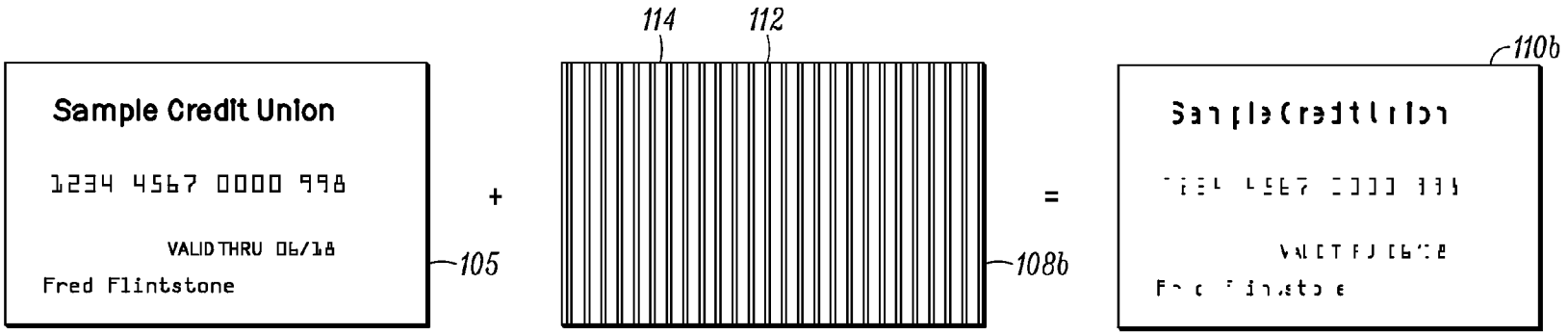
Figure 10C:
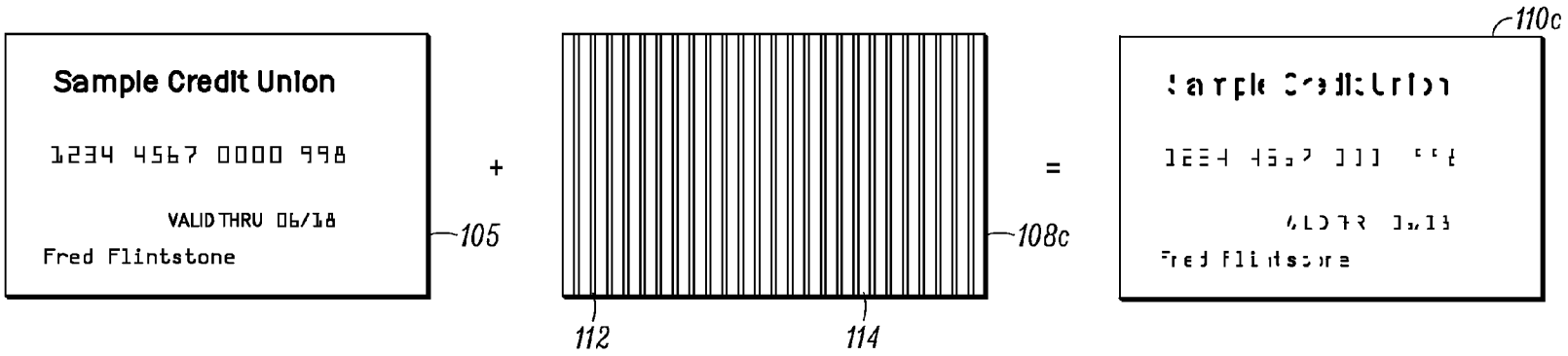

FIGS. 10A-C illustrate additional steps in the method of FIG. 8.

Figure 11:
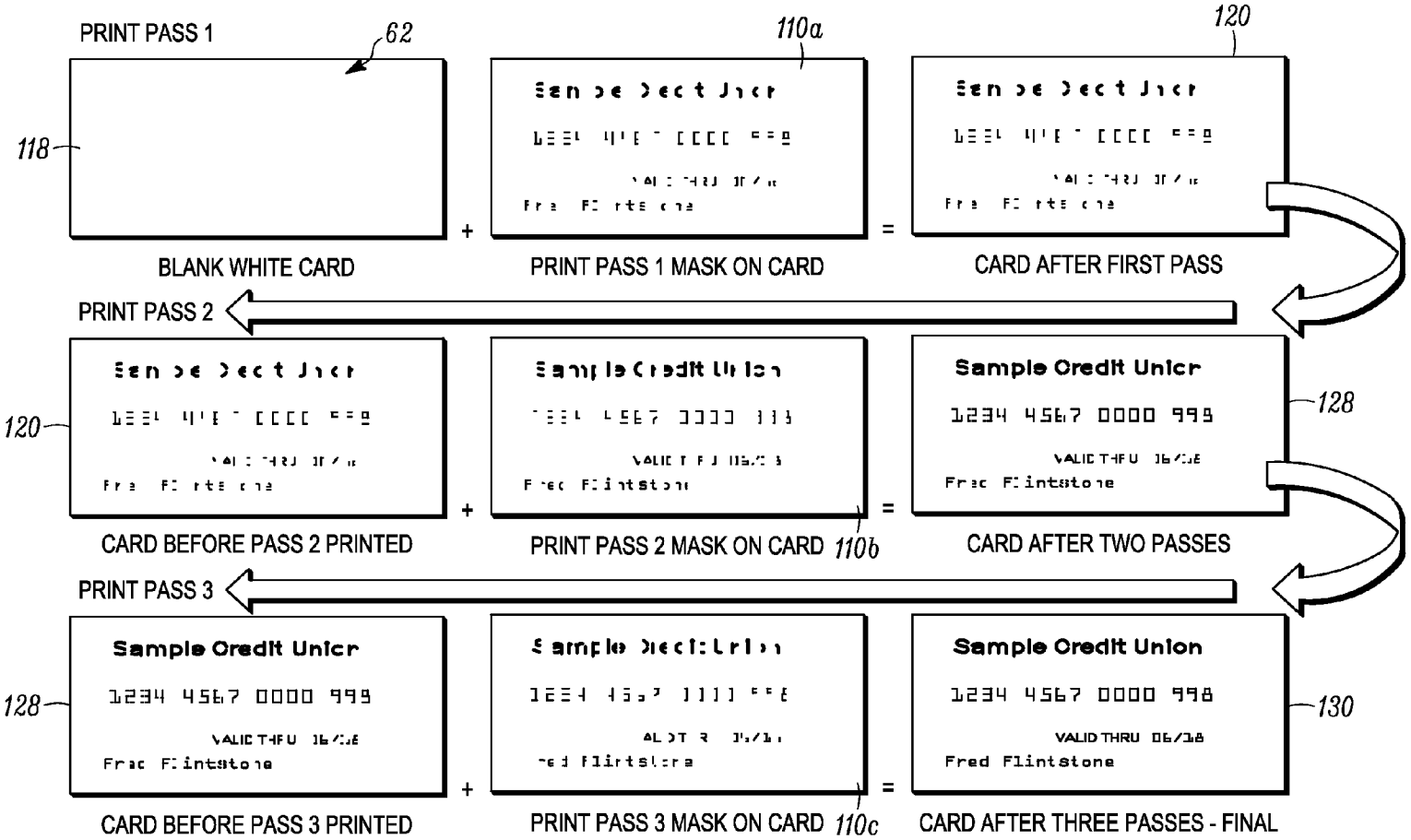

FIG. 11 illustrate additional steps in the method of FIG. 8.

Figure 12:
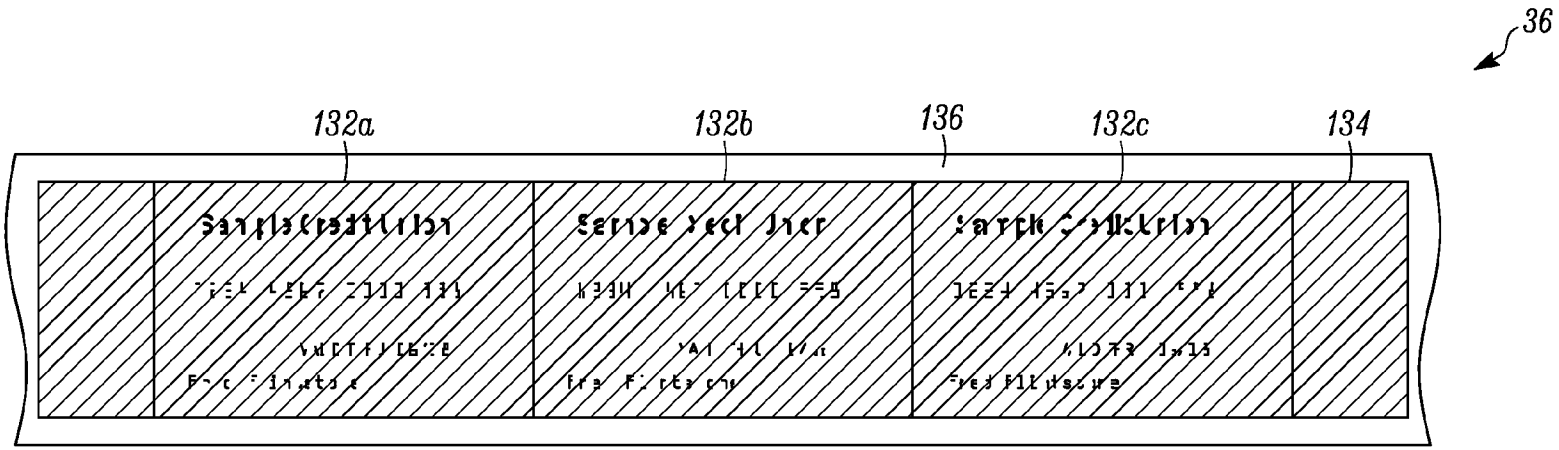

FIG. 12 illustrates one embodiment of a used print ribbon.

Figure 13:
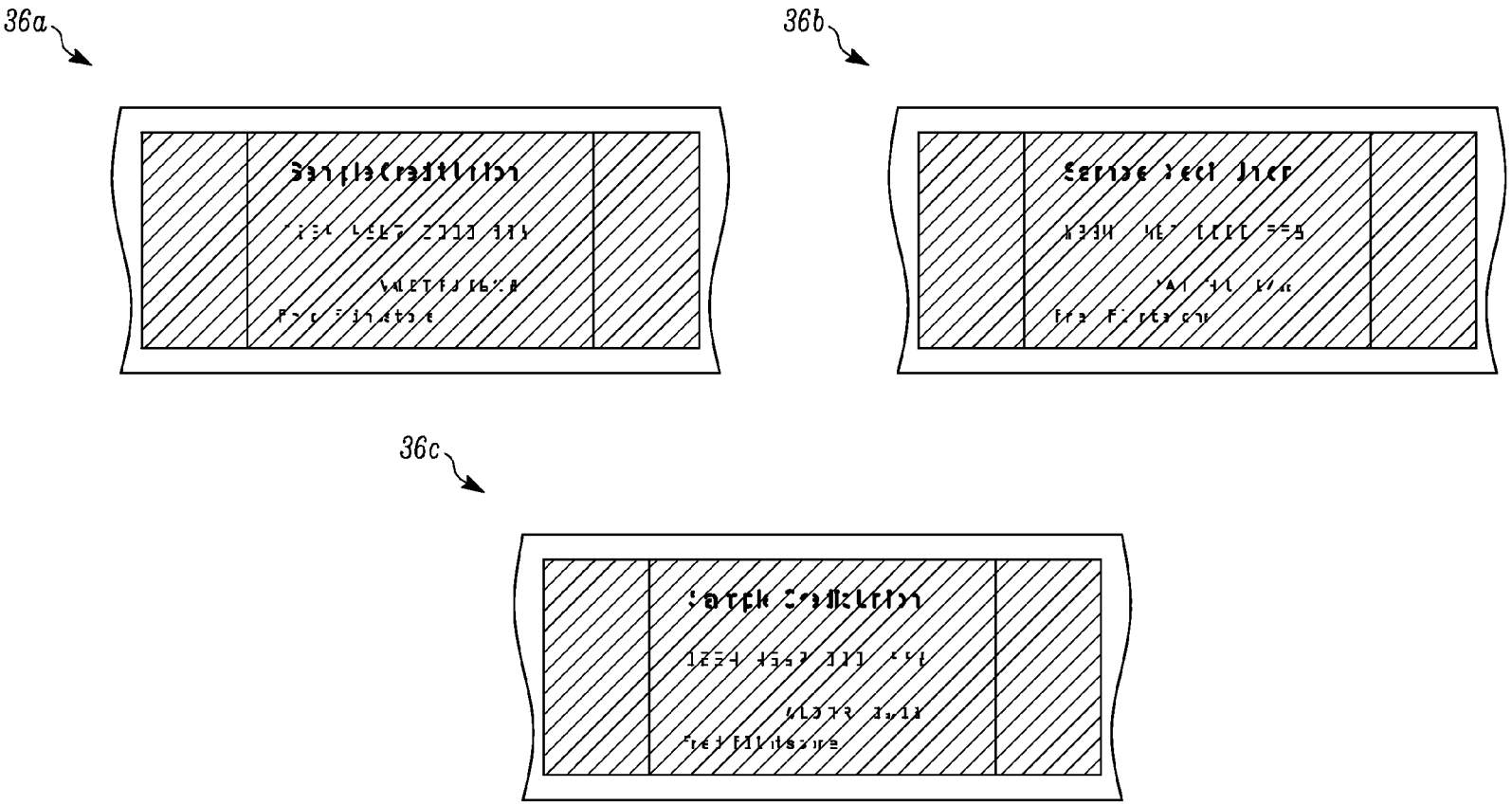

FIG. 13 illustrates an embodiment of multiple used print ribbons.

Figures 14A, 14B, 14C:
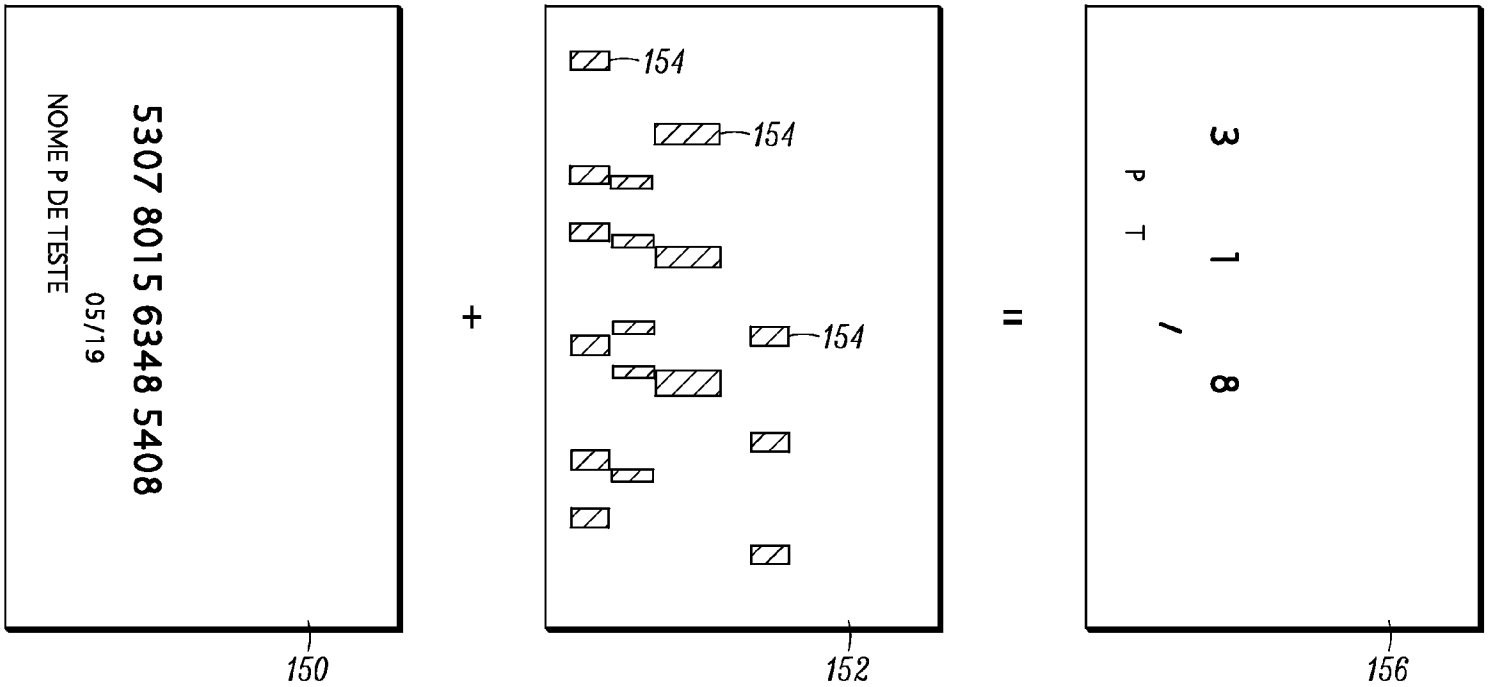

FIGS. 14A-C illustrate another embodiment of dividing the generated image into separate image portions using masks and printing image portions.

Figure 15:
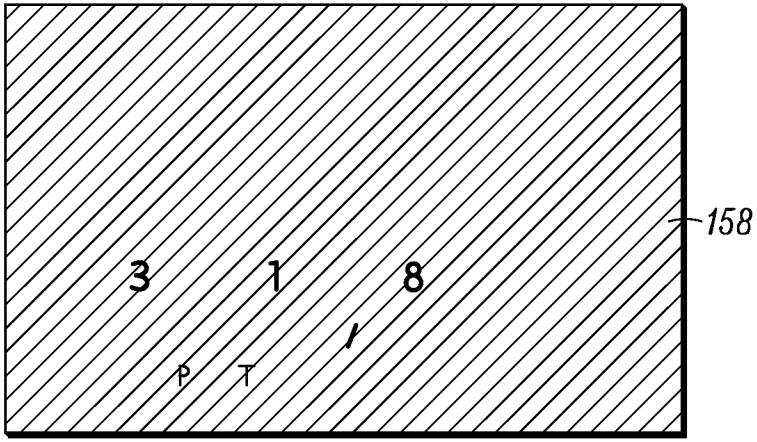

FIG. 15 illustrates a section of print ribbon used to print the image portion of FIG. 14C.

Figure 16A:
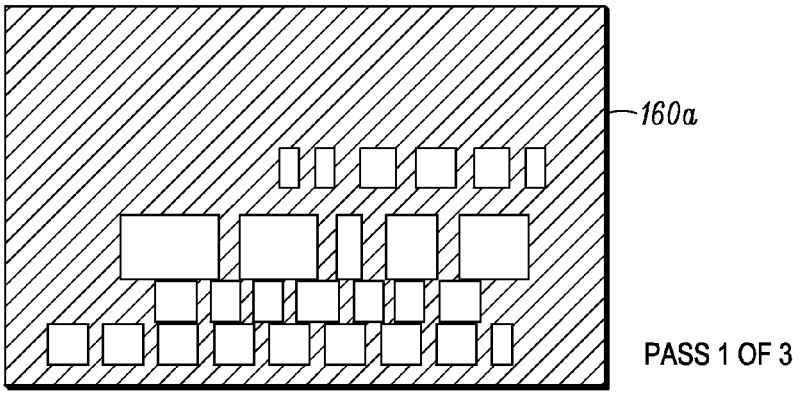
Figure 16B:
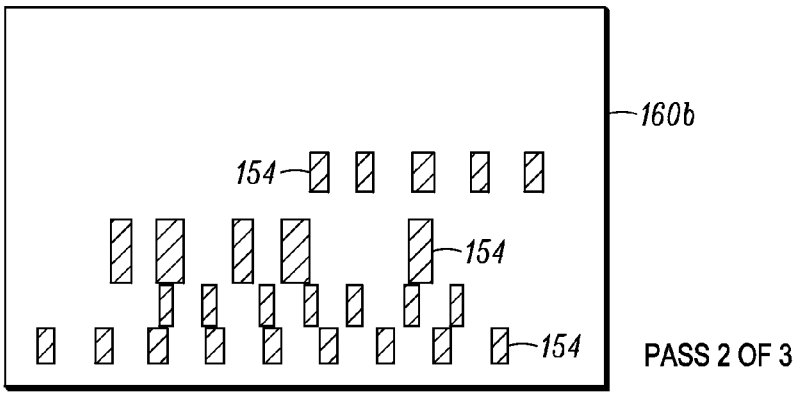
Figure 16C:
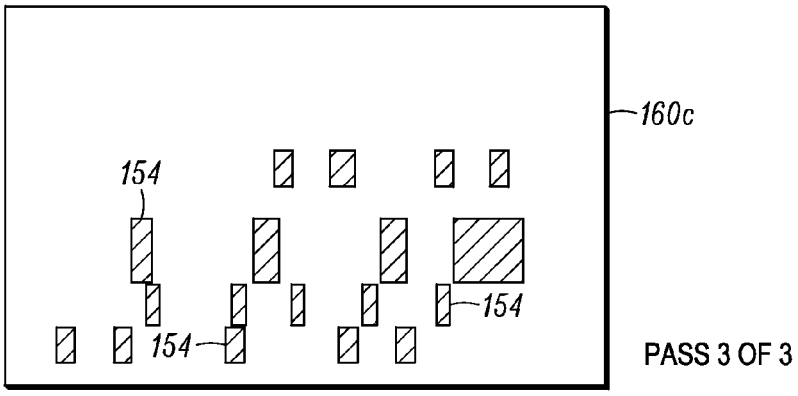

FIGS. 16A-C illustrate examples of three masks that can be used in a three pass process using the masking technique of the embodiment of FIGS. 14A-C.

DETAILED DESCRIPTION

Techniques are described that make it difficult for someone to obtain confidential or personal information from one or more used print ribbons after the print ribbon(s) has been used to print information on a surface of a substrate to form a personalized security document.

Examples of personalized security documents that can benefit from the techniques described herein include, but are not limited to, plastic cards (or similar cards formed from composite materials) that serve as identification cards, driver's licenses, financial cards (e.g., credit card, debit card), phone cards, health cards, or the like, as well as security documents such as passports.

The substrates that can be printed on include, but are not limited to, a plastic card substrate, a transfer material that is printed on and then transferred by lamination onto a plastic card substrate in a retransfer printing process, a page of a passport, or the like.

For sake of convenience, the security document will hereinafter be described as being a plastic card, and the printing will be primarily described as occurring directly on a plastic card substrate. However, other types of security documents and other types of substrates can be used.

For sake of convenience, the printing will hereinafter be described as occurring in a plastic card printer, which can be any type of plastic card printer where one or more print ribbons are used to print on the plastic card substrate. The printer can have a single print head and a single print ribbon, or multiple print heads with multiple print ribbons. In another embodiment, separate plastic card printers could even be used. However, other types of plastic card printers, with other variations of print heads and print ribbons can be used.

For sake of convenience, the print ribbon will hereinafter be described as being a dye diffusion print ribbon that includes a substrate web and thermally transferrable dye on the substrate web. However, other types of print ribbons, including ink ribbons, can be used. In general, the print ribbon can contain any colorant material, whether dye, ink or other type of colorant, in a continuous layer or in separate panels, that can be transferred from the print ribbon onto the plastic card or other substrate.

For sake of convenience, the print ribbon may hereinafter be described as being a monochromatic dye diffusion print ribbon containing a single continuous dye (i.e. colorant) layer of a single color such as black. However, the print ribbon can be a monochromatic print ribbon containing a plurality of separate dye or ink (i.e. colorant) panels of a single color, or a multi-color print ribbon with separate dye or ink (i.e. colorant) panels of differing colors such as a CMYK print ribbon.

Figure 1:
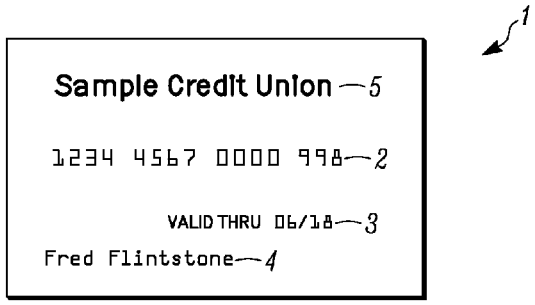
FIG. 1 (PRIOR ART)
FIG. 1 illustrates a prior art security document in the form of a card.
Figure 2:
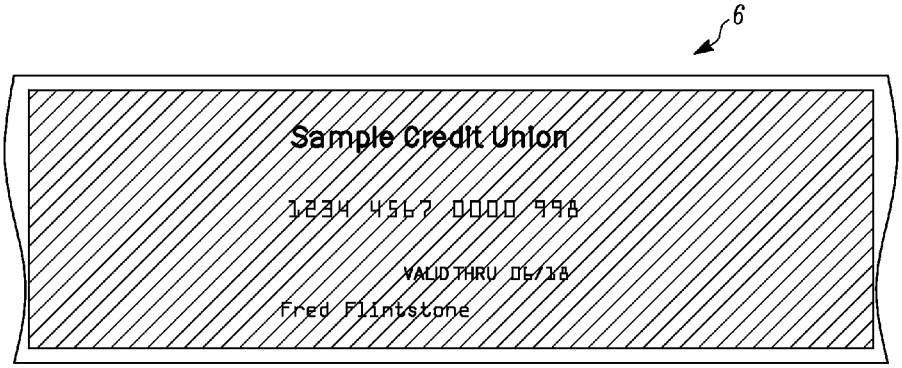
FIG. 2 (PRIOR ART)
FIG. 2 illustrates a used section of a ribbon that was used to print the card of FIG. 1.
Figure 3:
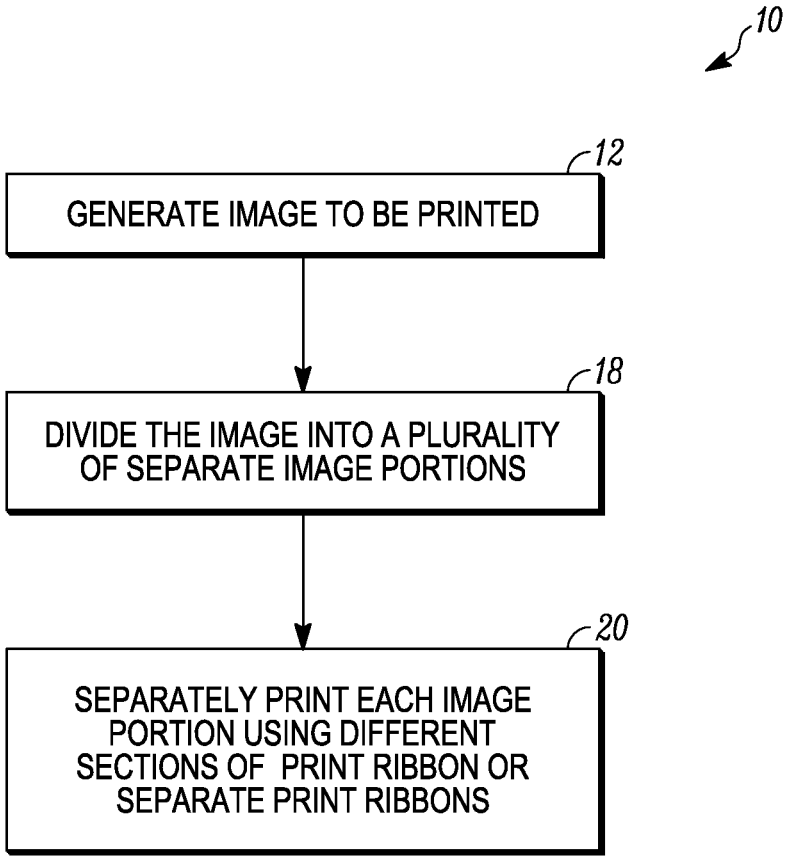
FIG. 3 illustrates one embodiment of a method of printing described herein.

With reference to FIG. 3, an embodiment of a printing method 10 is illustrated. In the method 10, an image to be printed is generated in step 12. The generated image can be an image of the desired layout of all of the text characters and graphics (if present) on the entire front surface of the plastic card substrate. For example, FIG. 9A shows an example of a generated image 14 of a desired layout of all of the text characters to be printed on the front surface of the plastic card substrate. In another embodiment, the generated image can be of only a portion of the text characters. For example, again with reference to FIG. 9A, the generated image could be of only an account number 16 and/or any other information that is considered confidential that one wishes to prevent others from obtaining from the uses print ribbon. The techniques for generating an image to be printed are well-known in the art of plastic card printing and other security document printing.

Returning to FIG. 3, the generated image is then divided, sliced, separated, etc. into a plurality of separate image portions in step 18. Each image portion forms only a piece of the generated image to be printed and contains only a portion of any confidential or personal information, such as the account number 16 in FIG. 9A, that one does not wish to appear in complete form on the used print ribbon. However, if combined, the separate image portions would form the complete generated image from step 12.

The terms divided, sliced, separated, etc. are used interchangeably herein to refer to any division of the generated, to-be printed image into separate pieces with each piece containing only a portion of the text information, such as the account number 16, that one wishes to prevent access to on the used print ribbon. FIGS. 8-11 discussed in detail below describe one embodiment of dividing the generated image into separate image portions.

Dividing the generated image in step 18 is intended to encompass dividing the image itself as well as dividing the data that forms the image. Whatever language is used, the techniques described herein are intended to encompass any result where separate portions or pieces of the generated image of step 12 result, with the separate portions or pieces then being separately printed onto the card substrate.

The resulting number of image portions formed is at least two. In one embodiment, the resulting number of image portions formed is three or more. In another embodiment, the resulting number of image portions is greater than or equal to three but less than or equal to five.

Returning to FIG. 3, in step 20, in one embodiment, each of the separate image portions is then printed by the card printer onto the plastic card substrate using different sections of the print ribbon. In another embodiment, the image portions are printed onto the plastic card substrate using separate print ribbons.

Figure 4:
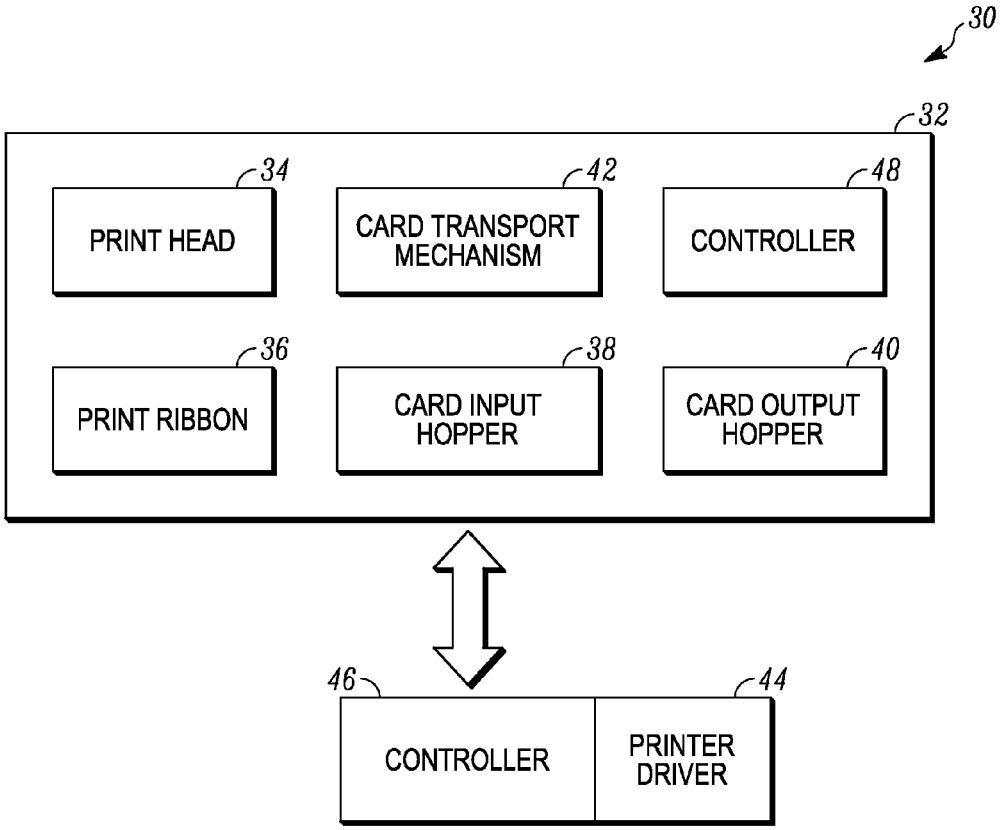
FIG. 4 illustrates one embodiment of a system described herein for implementing the printing process.

FIG. 4 is a schematic illustration of an embodiment of a system 30 for implementing the printing method 10 of FIG. 3. In the illustrated embodiment, the system 30 includes a card printer 32, for example a desktop card printer or a central issuance system, that includes at least one print head 34 of known construction, such as a thermal print head with a plurality of resistor elements. A replaceable print ribbon 36 is arrangeable adjacent to the print head 34 so as to be engaged by the print head 34 to transfer dye or ink from the print ribbon 36 onto a surface of the card. The card printer 32 can further include a card input hopper 38 that can hold a plurality of card substrates for feeding into the card printer 32 and a card output hopper 40 that can hold a plurality of card substrates that have been printed on (also referred to as personalized cards). A card transport mechanism 42 of known construction can transport cards through the card printer 32 from the input hopper 38, past the print head 34 and to the output hopper 40 after printing. Examples of card printers having such a construction are described in U.S. Pat. Nos. 7,434,728 and 6,902,107.

In this embodiment, the system 30 can also include a suitable printer driver 44 that generates the image to be printed, divides the image into the image portions, and sends the image portions to the printer 32 using a suitable printer command language. An example of a suitable printer driver is the XPS printer driver as used in the CD800 Desktop Card printer from Entrust Datacard Corporation. The printer driver 44 can be integrated with a controller 46 as illustrated in FIG. 4 or the printer driver 44 can be separate from the controller 46. The printer driver 44 and/or the controller 46 can be in well-known wired or wireless communication with the card printer 32.

The card printer 32 can also include a controller 48 included therewith that is in communication with the printer driver 44 and that is configured to receive the image portions and process the image portions to make them ready for printing by the print head 34 as well as control the flow of the card substrate through the printer 32.

The printer driver 44 includes a computer program product with one or more non-transitory computer-readable tangible storage devices, and program instructions stored on at least one of the one or more non-transitory computer-readable tangible storage devices which, when executed, perform the processing necessary to generate the image to be printed, divide the image into the image portions, and transmit the image portions to the printer 32.

The controller 48 includes a computer program product with one or more non-transitory computer-readable tangible storage devices, and program instructions stored on at least one of the one or more non-transitory computer-readable tangible storage devices which, when executed, perform the processing necessary to cause the plastic card printer to print the image portions on the surface of the plastic card substrate to create the desired image.

In another embodiment, the controller 46 can generate the image, divide the image into the image portions, and send the image portions to the printer 32. In this embodiment, the controller 46 would include a computer program product with one or more non-transitory computer-readable tangible storage devices, and program instructions stored on at least one of the one or more non-transitory computer-readable tangible storage devices which, when executed, perform the processing necessary to generate the image, divide the image into the image portions, send the image portions to the printer, and cause the plastic card printer to print the image portions on the surface of the plastic card substrate to create the desired image.

FIG. 4 shows the printer driver 44 and the controller 46 as being separate from and outside of the printer 32. However, in another embodiment, the printer driver 44 and/or the controller 46 can be integrated into and be part of the printer 32 itself. In this embodiment, the controller 46 may also perform the functions of the controller 48.

In an alternative embodiment, some or all of the operations of the card printer 32 can be performed and/or controlled by the remote controller 46 that is external to and remote from the card printer 32. For example, the controller 46 can perform the data processing functions of the method 10 including generating the image to be printed, dividing the image into the image portions, and sending the image portions to the printer, with the operations of the card printer 32, such as operation of the print head 34, the print ribbon 36, the card transport mechanism 42, etc., being controlled by the controller 46 and/or by the controller 48. In one embodiment, the printer driver 44 and/or the controller 46 can be accessible via a website that a user of the card printer 32 logs in to and that performs the data processing functions.

Figure 5:
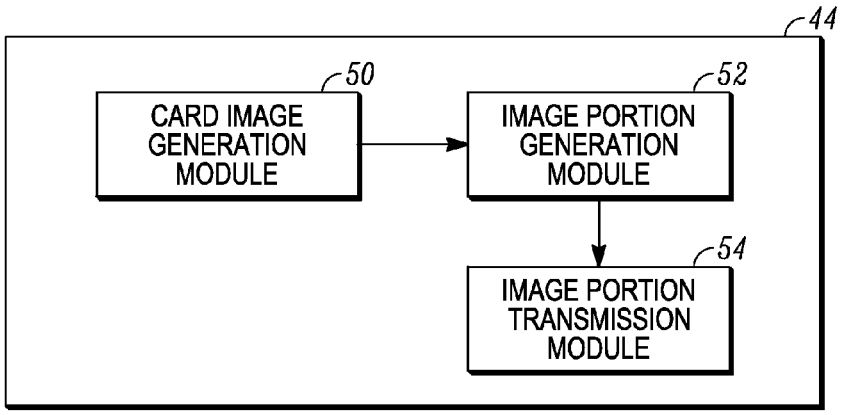
FIG. 5 illustrates one embodiment of a printer driver that can be used in the system described herein.

With reference to FIG. 5, an example construction of the printer driver 44 is illustrated. However, either one of the controllers 46, 48 could have a similar construction if the controller 46, 48 is intended to perform the functions of the printer driver 44.

In the example illustrated in FIG. 5, the printer driver 44 includes a card image generation module 50 that is configured, for example via suitable programming, to generate the image to be printed on the plastic card substrate by the plastic card printer 32. The card image generation module 50 generates the desired image based on data that is input, for example from a database, from a file, entered in real-time by the user, or the like. The input data can include the cardholder's name, the account number assigned to the cardholder, card expiration information, and data relating to any other text or graphics to be printed on the card substrate.

Once the card image is generated, the generated card image is provided to an image portion generation module 52 that is configured, for example via suitable programming, to generate the plurality of separate image portions from the generated card image. As indicated above, the number of image portions can be two or more, or three or more, or at least three but preferably not more than five.

The image portions are then provided to an image portion transmission module 54 that is configured, for example via suitable programming, to transmit each image portion to the printer 32. Each image portion is then separately printed on the surface of the plastic card substrate by the card printer.

The image portions can be sent to the printer 32 and printed in any desired order. For example, the image portions can be sent to the printer in the order they are created and ultimately printed in the same order. For example, in the case of three image portions created in sequence and labeled image portion 1, image portion 2, and image portion 3, the image portions can be transmitted to the printer 32 in the following sequence: image portion 1, image portion 2, and image portion 3; and ultimately printed in the same sequence. The order of transmission and subsequent printing can also be changed randomly so that when printing one card substrate, the image portions are transmitted and/or printed in a first sequence, and for the next card substrate to be printed the image portions are transmitted and/or printed in a second sequence different from the first sequence.

Figure 6:
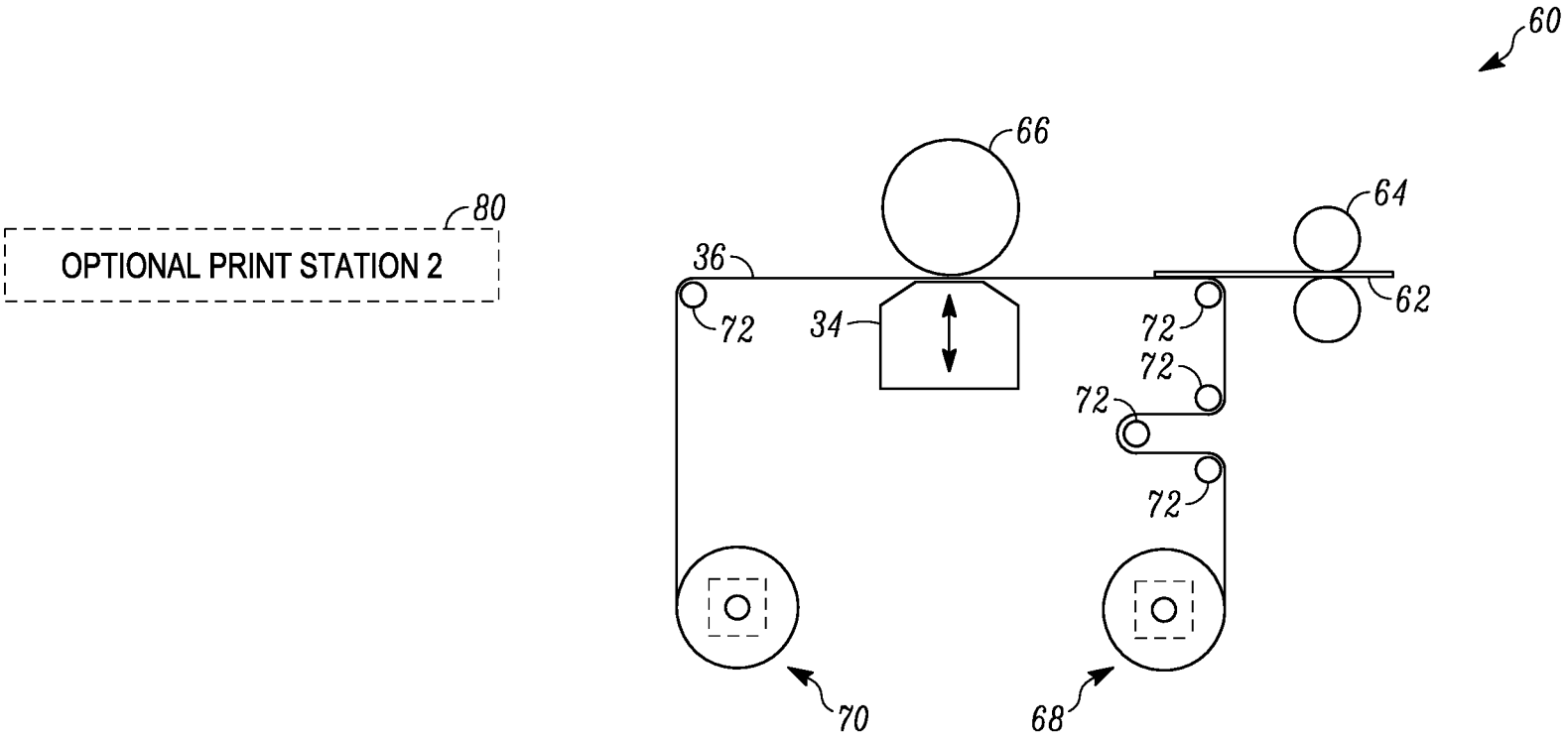
FIG. 6 illustrates one embodiment of a printer that can be used to implement the printing method described herein.

Referring to FIG. 6, an example of a print station 60 that can be used in the card printer 32 is illustrated. A card substrate 62 is input via input rollers 64 into printing position between the print head 34 and the print ribbon 36 and a backing roller 66. Typically, the print head 34 is movable toward and away from the backing roller 66 between a printing position and a card transport position as indicated by the arrow in FIG. 6. The print ribbon 36 is supplied from a supply roll 68 with used print ribbon being taken up on a take-up roll 70. Between the supply roll 68 and the take-up roll 70, the print ribbon is guided by a plurality of guide posts 72.

In use, the card substrate 62 is fed into position and printing of the first image portion begins. During printing, the card substrate 62 and the print ribbon 36 are fed at substantially the same rate past the print head 34, with the resistor elements of the print head 34 being suitably activated using conventional techniques to transfer dye or ink from the ribbon 36 to the card substrate 62 at appropriate locations. Once the first image portion is printed, the print head 34 is moved to the transport position, and the card substrate 62 is transported in reverse back to the initial print position. The print head 34 is then moved back to the printing position and the next image portion is printed on the card substrate 62 in appropriate registration with the first printed image portion. For each remaining image portion, this process is repeated. Even though the card substrate 62 is transported back to the initial print position, the print ribbon is not reversed when the card substrate is reversed. Therefore, the second image portion, and each image portion, will be printed using a different section of the print ribbon 36.

Continuing with FIG. 6, in an embodiment, one or more additional print stations 80 can be provided downstream from the print station 60. The print station(s) 80 can have a construction that is identical to the print station 60. In such an embodiment, rather than reversing the card substrate 62 in order to print second and subsequent image portions, after the first image portion is printed in the print station 60, the card substrate 62 is transported to the next print station 80 which prints the next image portion in appropriate registration with the first printed image portion. If there are further image portions to be printed, for each additional image portion the card substrate is transported downstream to the next print station to print the next image portion. Therefore, each image portion would be printed using a different print ribbon.

Figure 7:
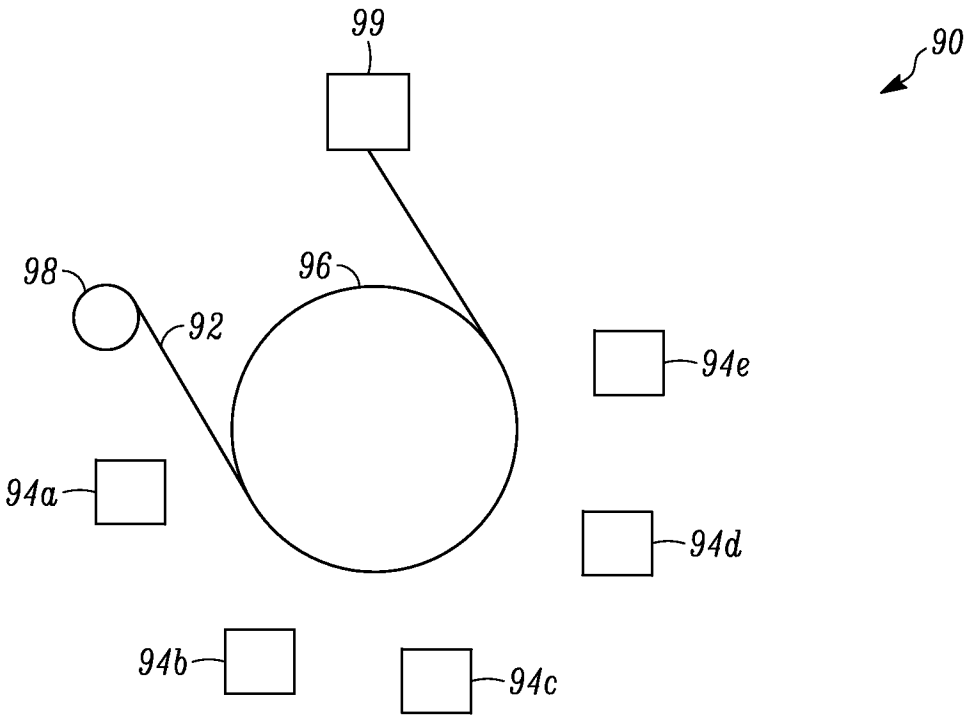
FIG. 7 illustrates another embodiment of a printer that can be used to implement the printing method described herein.

With reference to FIG. 7, an embodiment of a print mechanism 90 is illustrated where, rather than printing directly on a card substrate, the image portions are printed on a transfer material 92. Once the entire image is completely printed, the transfer material 92 containing the printed image is transferred to the card surface by a lamination process at a transfer station. This process is generally referred to as re-transfer printing, examples of which are described in U.S. Pat. No.

6,262,755 which is incorporated herein by reference in its entirety and from the SR300 Retransfer Card Printer available from Entrust Datacard Corporation of Shakopee, Minn.

In this example, five print stations 94*a-e* are disposed around a drum 96, with each print station 94*a-e* including a print head and a print ribbon for transferring dye or ink onto the transfer material 92 as the transfer material 92 moves around the drum 96. The transfer material 92 is provided from a supply roll 98, and after printing the image on the transfer material 92, the transfer material 92 is fed to a transfer station 99 to transfer the printed image to the card substrate. The use of five print stations 94*a-e* is optional, and a larger or smaller number of print stations can be used depending upon how many image portions need to be printed.

With reference now to FIGS. 8-11, an embodiment of dividing the generated image into separate image portions and printing the image portions is illustrated. In this embodiment, the image portions that are created from the generated image are referred to as mask images.

First, referring to FIG. 8, in this embodiment, a method of printing 100 includes a step 102 of generating the image to be printed onto a card substrate. The step 102 can be similar to the step 12 described above.

In step 104, multiple copies of the image generated in step 102 are created. The number of copies of the image that are created is equal to the number of image portions (or mask images) to be created and printed. For example, as illustrated in FIGS. 9A-C, three copies 105 of the generated image 14 can be created. However, a larger or smaller number of copies can be created.

Returning to FIG. 8, in step 106, each image copy 105 is then overlaid with a mask that hides a predetermined portion of the respective image copy 105 in order to generate a plurality of mask images. Each mask is configured to mask a respective percentage of its associated image copy 105, based on the number of image copies 105. For example, in the case of the three image copies 105 in FIGS. 9A-C, each mask is configured to mask two-thirds of its associated image copy 105, so that one-third of each image copy 105 remains visible. The masks described herein can be referred to as virtual masks since physical masks are not created. Instead, the masks are created virtually in the data processing that occurs in the image portion generation module 52 in FIG. 5.

FIGS. 10A-C illustrate an example of the masking technique in step 106. In this example, the three image copies 105 are illustrated. For each image copy, a respective mask 108*a*, 108*b*, 108*c* is created such that when the mask 108*a-c* is overlaid over its respective image copy 105, a portion of each image copy 105 is covered by the mask while the remaining portion of each image copy 105 is not covered. The result is three mask images 110*a*, 110*b*, 110*c*. The masks 108*a-c* hide different portions of each image copy 105 such that when the three mask images 110*a-c* are combined, the entire generated image 14 is produced. So in FIG. 10A, the image copy 105 and the mask 108*a* results in the mask image 110*a* where one-third of the generated image 14 is visible. In FIG. 10B, the image copy 105 and the mask 108*b* results in the mask image 110*b* where a different one-third of the generated image 14 is visible. In FIG. 10C, the image copy 105 and the mask 108*c* results in the mask image 110*c* where a different one-third of the generated image 14 is visible.

For ease of explanation, the masks 108*a-c* in FIGS. 10A-C are illustrated as being a series of solid colored bars 112 alternating with transparent bars 114. The solid colored bars 112 cover the portions of the image 14 underlying the bars 112 while the portions of the image 14 underlying the transparent bars 114 are not covered. For each of the masks 108*a-c*, the sizes, positions, shapes, etc. of the solid bars 112 and the transparent bars 114 can vary to mask the desired areas of the underlying image copies 105. In one embodiment, the portions of the image 14 underlying the bars 112 form the respective resulting mask images 110*a-c* that are ultimately printed, while the portion of the image not covered by the solid bars 112 are not printed. Alternatively, in another embodiment, the portions of the image 14 not covered by the bars 112 form the resulting mask images 110*a-c* that are ultimately printed, while the portions of the image covered by the solid bars 112 are not printed. The masks 108*a-c* are configured such that no single one of the resulting mask images 110*a-c* completely contains any confidential or personal information that it is desired to prevent access to in the used print ribbon. In the illustrated example, the solid bars 112 and the transparent bars 114 extend vertically relative to the image copies 105. However, the bars 112, 114 can extend horizontally or at any angle between horizontal and vertical. In addition, the masks 108*a-c* are not limited to bars 112, 114. Any pattern, shape, design, sizes, etc. of solid areas and transparent areas can be used that results in creation of the mask images 110*a-c*. FIGS. 14-16 discussed further below describe an alternative example of mask images. Further, although the use of a masking technique has been described, any technique of taking the generated image and creating a plurality of image portions from the generated image that are similar in concept to the mask images 110*a-c* can be used.

Returning to FIG. 8, in step 116 after a card substrate is input into the card printer, one of the mask images 110*a-c* is printed onto the card substrate using the print head and print ribbon discussed above. For example, with reference to FIG. 11, a card substrate 62 is input into the printer. In this example, the card substrate is a blank white card with a first blank, generally planar surface 118 (typically the intended front surface of the card) and a second blank, generally planar surface (not shown) opposite the first surface 118. In a first print pass, one of the mask images, such as the mask image 110*a*, is printed onto the surface 118 of the card substrate 62 to produce a first intermediate printed card 120.

Returning to FIG. 8, after the first print pass, in step 122, the process 100 determines whether there are any remaining mask images to be printed. If the decision at step 122 is no, the process 100 determines that printing is complete 124 and the completed card can be output from the card printer or subject to further card processing. If the decision at step 122 is yes, the process 100 proceeds to step 126 where the card substrate is transported in a reverse direction back to a print position for a second print pass in which a second one of the mask images is printed in step 116. However, the print ribbon is not reversed in direction. Instead, during the second print pass and each other subsequent print pass, printing on the surface 118 occurs using a new section of the print ribbon.

For example, with reference to FIG. 11, the first intermediate printed card 120 is transported in the reverse direction back past the print head and positioned for the second print pass. Once in position, the first intermediate printed card 120 is transported past the print head in the second print pass using a new section of print ribbon to print a second one of the mask images, such as the mask image 110*b*, onto the surface 118 to produce a second intermediate printed card 128.

Returning to FIG. 8, if step 122 again determines that there are remaining mask images to be printed the process 100 proceeds to step 126 and back to step 116 for another print pass. For example, with reference to FIG. 11, the second intermediate printed card 128 is transported in the reverse direction back past the print head and positioned for a third print pass. Once in position, the second intermediate printed card 128 is transported past the print head in a third print pass to print a third one of the mask images, such as the mask image 110*c*, onto the surface 118 using yet another new section of print ribbon to produce the final printed card 130 containing the generated image 14.

During each print pass and return of the card substrate back for each new print pass, the positioning of the card substrate is such that once printing is complete, the mask images 110*a-c* substantially align with one another such that they form the desired generated image which can be seen by comparing the images 14 in FIGS. 9A-C with the final printed card 130 in FIG. 11.

Although the mask images are described as being printed in the sequence 110*a*→110*b*→110*c*, any print sequence can be used. In addition, the print sequence of the mask images can vary for each card substrate being printed.

FIG. 12 illustrates an example of the print ribbon 36 after printing of the mask images 110*a-c*. In this example, the print ribbon 36 contains a continuous layer of thermally transferrable dye or ink 134, such as black dye or ink, disposed on a substrate web 136. The used print ribbon 36 includes a plurality of sequential, separate image portions formed in the thermally transferrable dye or ink on the substrate web each of which corresponds to one of the mask images 110*a-c*. If the image portions on the print ribbon are combined together, the resulting combined image would be identical to the image 14 printed on the surface of the final printed card 130.

For example, the print ribbon 36 includes one portion 132*a* that was used to print one of the mask images, a second portion 132*b* that was used to print a second one of the mask images, and a third portion 132*c* that was used to print a third one of the mask images. In this example, the portion 132*a* was used to print the mask portion 110*b*, the portion 132*b* was used to print the mask portion 110*a*, and the portion 132*c* was used to print the mask portion 110*c*. Therefore, the mask images were printed in the sequence 110*b*→110*a*→110*c*.

FIG. 13 illustrates an embodiment where, instead of using a single print ribbon to print each mask image, separate print ribbons 36*a*, 36*b* 36*c* are used to print each mask image. For example, the print ribbon 36*a* was used to print the mask image 110*b*, the print ribbon 36*b* was used to print the mask image 110*a*, and the print ribbon 36*c* was used to print the mask image 110*c*.

The print ribbons illustrated in FIGS. 12 and 13 are examples only. Many variations can exist. The print ribbon used can have individual panels of dye or ink, for example like in a CYMK print ribbon, with each panel being used to print one of the mask images. The ribbon portions 132*a-c* need not be arranged one after the other as illustrated in FIG. 12. Instead, the ribbon 36 can be advanced a distance after each printing pass so that there is a gap between each ribbon portion 132*a-c*. However, the ribbon portions 132*a-c* would still be considered sequential. It is also possible to advance and reverse the print ribbon after certain print passes such that the print portions 132*a-c* used to print one card are intermingled with the print portions 132*a-c* used to print another card. Any variations that results in the mask images being printed on separate portions or sections of print ribbon can be utilized.

FIGS. 14-16 another embodiment of dividing the generated image itself into separate image portions using masks and printing image portions. In this embodiment, entire data characters are printed during each printing pass wherever possible. For example, an entire letter "A" or an entire number "1" is printed whenever possible. This is in contrast with the embodiment described above in FIGS. 10-11 where the masking can result in an individual character being partially printed during a single printing pass, with multiple printing passes being needed to result in the entire individual character being printed.

FIG. 14A illustrates an image 150 of a card that is to be printed. Similar to the embodiment described in FIGS. 10A-C above, two or more, for example three to five, of the images 150 can be generated. For each image copy 150, a respective mask image 152 is created. In this embodiment, each mask image 152 can include a plurality of solid color bars 154. When the mask image 152 is overlaid over its respective image copy 150, certain ones of the bars 154 overlay certain ones of the data characters on the image copy 150. Any data character that lies below one of the mask bars 154 will be printed. For example, when the mask image 152 is overlaid over the image 150, the individual characters "3", "1", "8", "/", "P" and "T" are covered by the bars 154. Therefore, as shown in FIG. 14C, a first intermediate printed card 156 resulting from a single printing pass will result in the individual characters "3", "1", "8", "/", "P" and "T" being printed in their entireties on the card 156. The first intermediate printed card 156 would then be repositioned for a second printing pass using a second differently configured mask with bars 154 that overlay other data characters which will then be printed. This process is repeated until the entire intended card image 150 is printed on the card.

As with the embodiments described above, a new section of ribbon, or a different print ribbon, will be used in each printing pass to print the data characters for that printing pass. FIG. 15 illustrates a section of print ribbon 158 that was used to print the data characters in FIG. 14C.

FIGS. 16A-C illustrate examples of three mask images that can be used in a three pass printing process using the masking technique of the embodiment of FIGS. 14A-C. FIG. 16A illustrates a mask image 160*a* that can be used to print elements on the card other than the data characters, such as background printing, printing of a logo, and the like, during a first printing pass. The solid colored areas cover areas of the card surface other than where the data characters are located, so that those areas are printed. If desired, the mask image 160*a* can be configured to overlay some of the data characters so that those data characters are also printed during the first printing pass. FIG. 16B illustrates a mask image 160*b* that can be used to print certain ones of the data characters (i.e. the data characters overlaid by the bars 154) onto the card during a second printing pass. FIG. 16C illustrates a mask image 160*c* that can be used to print the remaining ones of the data characters (i.e. the data characters overlaid by bars 154) onto the card during a third printing pass. Similar techniques can be used where four mask images and four printing passes, five mask images and five printing passes, and the like, are employed.

The following additional inventive aspects from the preceding disclosure can be summarized as follows:

In aspect 1, a system includes a plastic card printer having a print head, and a print ribbon; a printer driver in communication with the plastic card printer; a controller in communication with the plastic card printer and the printer driver; either the printer driver or the controller includes a) a card image generator that generates an image to be printed on a surface of a plastic card substrate, b) an image portion generator that generates a plurality of separate image portions from the generated image to be printed, and c) an image portion transmitter that transmits each image portion to separately print each image portion on the surface of the plastic card substrate using a different section of the print ribbon.

Aspect 2 is the system of aspect 1, wherein the image portion generator has a plurality of mask images, and each separate image portion is associated with a respective one of the mask images.

Aspect 3 is the system of aspect 2, wherein each mask image includes a plurality of bars that overlay select portions of the image to be printed.

Aspect 4 is the system of aspect 3, wherein each image portion comprises portions of the image to be printed that are overlaid by the bars on the respective mask image.

In aspect 5, a plastic card printer driver comprises an image generation module that is configured to generate an image to be printed on a surface of a plastic card substrate by a plastic card printer; an image portion generation module that is configured to generate a plurality of separate image portions from the generated image; and an image portion transmission module that is configured to transmit each image portion to the plastic card printer to separately print each image portion on the surface of the plastic card substrate.

In aspect 6, a computer program product is provided that works with a plastic card printer and that includes one or more non-transitory computer-readable tangible storage devices, and program instructions stored on at least one of the one or more non-transitory computer-readable tangible storage devices which, when executed, perform the following to cause the plastic card printer to print an image on a surface of a plastic card substrate:

generating an image to be printed on the surface of the plastic card substrate by the plastic card printer;

generating a plurality of separate image portions from the generated image; and transmitting each image portion to the plastic card printer to cause each image portion to be separately printed on the surface of the plastic card substrate, with the image portions that are printed on the surface of the security document substrate form the image.

Aspect 7 is the computer program product of aspect 6 wherein the plurality of separate image portions are generated using a plurality of mask images, and each separate image portion is associated with a respective one of the mask images.

Aspect 8 is the computer program product of aspect 7, wherein each mask image includes a plurality of bars that overlay select portions of the image to be printed.

Aspect 9 is the computer program product of aspect 8, wherein each image portion comprises portions of the image to be printed that are overlaid by the bars on the respective mask image.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A process of printing an image on a surface of a card substrate using a printer with a print head and a print ribbon, comprising:

generating an image that is to be printed on the surface of the card substrate;

dividing the image into a plurality of separate image portions, wherein the plurality of separate image portions are generated using a plurality of mask images, and each separate image portion is associated with a respective one of the mask images;

inputting the card substrate into the printer; and printing each image portion on the surface of the card substrate using the print head and a separate section of the print ribbon, and the image portions printed on the surface of the card substrate form the image.

2. The process of claim 1, wherein the image is divided into 3-5 separate image portions.

3. The process of claim 1, wherein the image comprises an account number.

4. The process of claim 1, wherein the print ribbon is a monochrome ribbon with a continuous dye or ink layer or a ribbon with a plurality of dye or ink panels.

5. The process of claim 1, wherein each mask image includes a plurality of bars that overlay select portions of the image to be printed.

6. The process of claim 5, wherein each image portion comprises portions of the image to be printed that are overlaid by the bars on the respective mask image.

7. A method, comprising:

generating an image that is to be printed on a surface of a security document substrate;

dividing the image into a plurality of separate image portions, wherein the plurality of separate image portions are generated using a plurality of mask images, and each separate image portion is associated with a respective one of the mask images;

separately printing each image portion on the surface of the security document substrate using:

a) a print head and a print ribbon, and each image portion is printed using a new section of the print ribbon; or b) a plurality of print head and print ribbon combinations, and each image portion is printed using a separate one of the print head and print ribbon combinations; and the image portions printed on the surface of the security document substrate form the image.

8. The method of claim 7, wherein the security document substrate is a plastic card substrate or a page of a passport.

9. The method of claim 7, wherein the image is divided into 3-5 separate image portions.

10. The method of claim 7, wherein the image comprises an account number.

11. The method of claim 7, wherein each mask image includes a plurality of bars that overlay select portions of the image to be printed.

12. The method of claim 11, wherein each image portion comprises portions of the image to be printed that are overlaid by the bars on the respective mask image.

13. A plastic card printer, comprising:

a thermal print head;

a print ribbon engageable by the thermal print head to transfer dye or ink from the print ribbon onto a surface of a plastic card substrate;

a printer controller that controls operation of the plastic card printer;

a printer driver connected to the plastic card printer, the printer driver includes:

an image generator that generates an image to be printed;

an image portion generator that generates a plurality of separate image portions from the generated image, the image portion generator has a plurality of mask images, and each separate image portion is associated with a respective one of the mask images; and an image portion transmitter that transmits each image portion for printing by the plastic card printer.

14. The plastic card printer of claim 13, wherein each mask image includes a plurality of bars that overlay select portions of the image to be printed.

15. The plastic card printer of claim 14, wherein each image portion comprises portions of the image to be printed that are overlaid by the bars on the respective mask image.

* * * * *